US005964391A

United States Patent [19]

Cain et al.

[11] Patent Number: 5,964,391

[45] Date of Patent: Oct. 12, 1999

[54] WRAP DETECTION DEVICE

[75] Inventors: Terry Robin Cain, Greenwood; Edward Joseph Delawski, Wilmington; Donald William Gillespie, Seaford, all of Del.; Melvin Harry Johnson, Chadds Ford, Pa.; John Christopher Modla, Hockessin, Del.; Jerry Fuller Potter; Jon Ovitt Stanley, both of Seaford, Del.

[73] Assignee: E. I. du Pont de Nemours and Company, Wilmington, Del.

[21] Appl. No.: 08/957,033

[22] Filed: Oct. 24, 1997

[51] Int. Cl.[6] ..... B65H 26/00; G01N 21/86

[52] U.S. Cl. ..... 226/45; 250/559.4; 356/429; 226/11

[58] Field of Search ..... 226/11, 45; 356/238.1, 356/238.2, 429; 250/559.43, 559.4, 341.1, 341.7, 341.8, 353

[56] References Cited

U.S. PATENT DOCUMENTS

| | | | |
|---|---|---|---|
| 3,803,822 | 4/1974 | Mulligan . | |
| 3,820,699 | 6/1974 | Bowen | 226/43 |
| 4,188,545 | 2/1980 | McClean et al. | 250/559.4 |
| 4,525,630 | 6/1985 | Chapman | 250/559.4 |
| 4,546,263 | 10/1985 | Gotoh et al. | 250/559.43 |
| 4,704,034 | 11/1987 | Takenaka et al. | 356/429 |
| 4,999,488 | 3/1991 | Sollars | 356/429 X |
| 5,067,215 | 11/1991 | Behl et al. . | |
| 5,701,180 | 12/1997 | Saindon et al. | 356/429 |
| 5,762,252 | 6/1998 | Reitano | 226/45 |
| 5,767,963 | 6/1998 | Berger | 250/559.4 X |

FOREIGN PATENT DOCUMENTS

| | | |
|---|---|---|
| 0 128 240 | 12/1984 | European Pat. Off. . |
| 29 36 055 | 3/1980 | Germany . |
| 2935111 | 7/1987 | Germany . |
| 3803751 | 8/1989 | Germany . |
| WO/89/07672 | 8/1989 | WIPO . |

*Primary Examiner*—Michael R. Mansen

[57] ABSTRACT

A sensor for use with a yarn processing apparatus that includes at least one roll over at least a portion of the surface of which at least one yarn is conveyed is operative to generate an accumulation signal representative of a wrap accumulation of yarn circumferentially around the surface of the roll.

5 Claims, 5 Drawing Sheets

WRAP DETECTION DEVICE

BACKGROUND OF THE INVENTION

1. Field of the Invention

The present invention is directed toward an apparatus for detecting the presence of a wrap accumulation of yarn on the surface of a heated or unheated roll in a synthetic yarn processing apparatus.

2. Description of the Prior Art

All textile processes handling yarn under tension have some level of broken filaments that can create roll wraps, especially when a plurality of yarn lines in a generally planar warp array are being processed by surface contact with a plurality of rolls. The processing may frequently involve heating the rolls. The rolls are usually shiny to achieve high friction for the desired draw forces and intimate contact with the yarn for rapid heat transfer to the yarn. Often four or more rolls with various surface and friction properties are used in succession to heat the yarn to a processing temperature for a particular length of time. Because of the elastic nature of synthetic polymers, broken filaments that may occur from time to time tend to stick to the processing rolls and accumulate thereon as wraps which may subsequently result in breaking of the yarn. Wrap detection is important for the commercial success of a warp machine for processing multiple yarns where the loss of a single end can cause the entire warp to shut down.

In an environment without automated assists, the detection of a wrap accumulation of yarn on a roll is a difficult matter. When a wrap occurs on a roll in a warp machine the operator must detect it quickly before a band of yarn greater than a predetermined threshold (typically, on the order of about one-eighth inch) accumulates on the roll. If left unattended the band might become so large that fluff would be created during removal, which would interfere with other yarn lines. The yarn may be white or another light color, providing little visual contrast with the surface of the roll, and making detection more difficult. Moreover, plural lines may break down at the same time due to process upsets. The operator needs to be able to identify which of a plurality of yarn lines are wrapping on the rolls so some appropriate action can be taken.

In view of the foregoing it is believed that there is a need for a system that will detect wrap accumulation on the surface of a roll. Such a system must be sufficiently robust so as to survive in the hot finish-laden atmosphere surrounding the hot rolls and must be affordable, reliable, and easily maintained. Of particular importance is the need to detect a wrap of one or several of a plurality of individual moving yarn lines on the surface of a roll and provide a suitable signal to an operator or an automated system so corrective action for the individual line or lines can be taken without disturbing the surrounding yarn lines. Such a sensor system needs to be adapted for easy cleaning, and for operation in a failsafe manner in case of malfunction of the sensor or failure of the operator to respond.

SUMMARY OF THE INVENTION

The present invention is directed to a sensor for use with a yarn processing apparatus that includes at least one roll over at least a portion of the surface of which at least one yarn is conveyed. However, it will be readily understood that the sensor of the present invention may be used with advantage in a warp processing environment, in which a plurality of yarns are arranged in a generally planar array as the yarns move through the processing apparatus. In such an instance the sensor monitors each of a plurality of inspection "lanes" defined transversely across the roll with which the sensor is associated.

The sensor is positioned at a predetermined operational position with respect to the surface of the roll and is operative to generate an accumulation signal representative of a wrap accumulation of yarn circumferentially around the surface of the roll. The sensor is configured to interrogate the surface of the roll from a distance spaced therefrom, and to sense the presence of a wrap by indirect inspection of the wrap.

The sensor comprises an infrared transmitter and associated infrared receiver, each coupled via a respective fiber optic link, to direct infrared energy toward or to collect infrared energy reflected from the surface of the roll. The receiver is responsive to the diminution of infrared radiation reflected from the surface of the roll due to the wrap accumulation of yarn on the roll to generate the accumulation signal.

The sensor is mounted in a housing that is rotationally and tiltably supported relative to the roll surface to yield in a failsafe manner to excess wrap buildup on the roll surface that may go undetected during a sensor malfunction. The rotational support also facilitates reorientation of the operative end of the sensor to a position away from the roll surface to permit periodic cleaning.

BRIEF DESCRIPTION OF THE DRAWINGS

The invention will be more fully understood from the following detailed description thereof, taken in connection with the accompanying drawings, which form a part of this application, and in which.

DETAILED DESCRIPTION OF THE FIGURES

Figure 1:
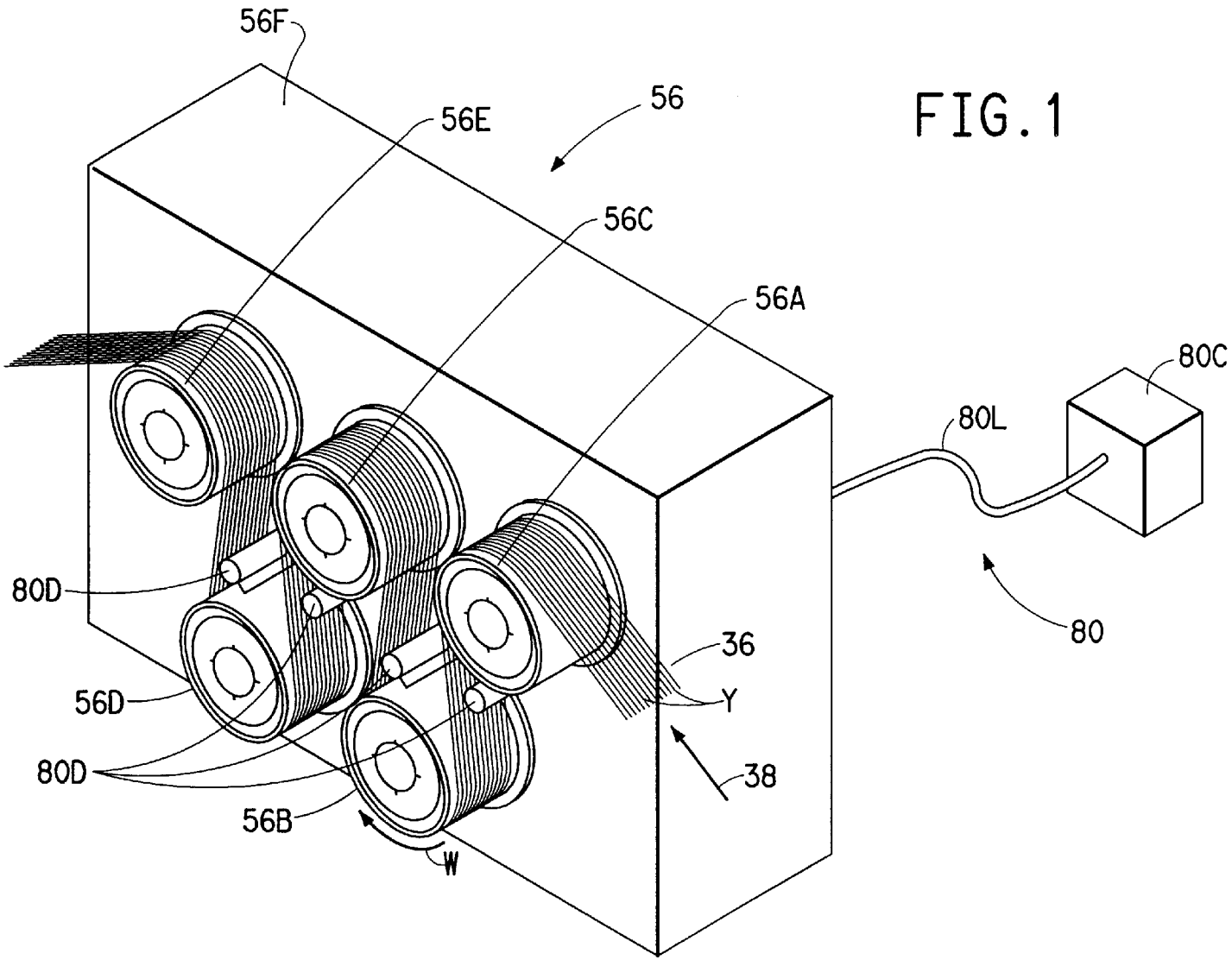
FIG. 1 is a stylized perspective view of an apparatus for processing yarns arranged in a warp with which the sensor arrangement of the present invention may be utilized.

Throughout the following detailed description similar reference numerals refer to similar elements in all Figures of the drawings.

FIG. 1 is a stylized perspective view of a treatment module, generally indicated by the reference character 56, for treating plural yarns organized in a warp configuration 36 as they pass over rolls 56A–56E. By "warp configuration" it is meant that the individual yarns Y comprising a warp are parallel to each other and are arranged in a generally planar array. Associated with one or more of the rolls in the treatment module 56 is a sensor for monitoring the surface of the rolls, such as sensors 80 that are shown monitoring rolls 56A–56D. The rolls are mounted on a cabinet 56F that contains the drives for the rolls and may contain some portion of the treatment means that interacts with the rolls for treatment of the yarn. In the case of heating the yarn, the cabinets may contain induction heating means for heating the rolls. The sensors 80 include a detector component 80D attached to the cabinet 56F adjacent the rolls, a communication link 80L, and a control component 80C spaced from the harsh environment surrounding the rolls. The control component 80C may be spaced from the cabinet as shown, or it may be inside an appropriately designed cabinet that offers protection from the roll environment.

Each yarn Y in the warp is produced in a conventional manner in a spinning apparatus (not shown). The spaced yarns forming the warp 36 may have passed through suitable finish applicators (not shown) prior to reaching the treatment module 56. Adjacent yarns in the warp 36 are spaced from each other by a transverse clearance distance. The warp proceeds in the direction of the reference arrow 38 through the apparatus over each roll 56A–56E and on to further yarn processing. As used herein, the term "downstream" when used to refer to the relationship between elements, refers to the spatial disposition of one member with respect to the other in the direction of the reference arrow 38; while the term "upstream" refers to the spatial disposition of one member with respect to the other in a direction directly opposed to the direction of the reference arrow 38.

In the event the treatment rolls 56A–56E are used to heat the yarn, they may have a polished surface for achieving good frictional surface contact with the yarn and to provide high heat transfer with the yarns. The surface of these rolls may reach temperatures of about two hundred degrees Centigrade (200° C.). The rolls may be heated by induction heating means so the electrical environment surrounding the rolls may be very noisy with high magnetic fields. The heated rolls may be turning at elevated speeds so any finish applied to the yarn may become airborne as the heated yarn travels from one roll to the next. The sensors 80 in this environment must be able to withstand these electrical, thermal, and optical disturbances. Accordingly, the sensors 80 employ fiber optics to conduct signals to and from the rolls and to space the controls for the sensors far from the operating environment of the rolls.

Figure 2:
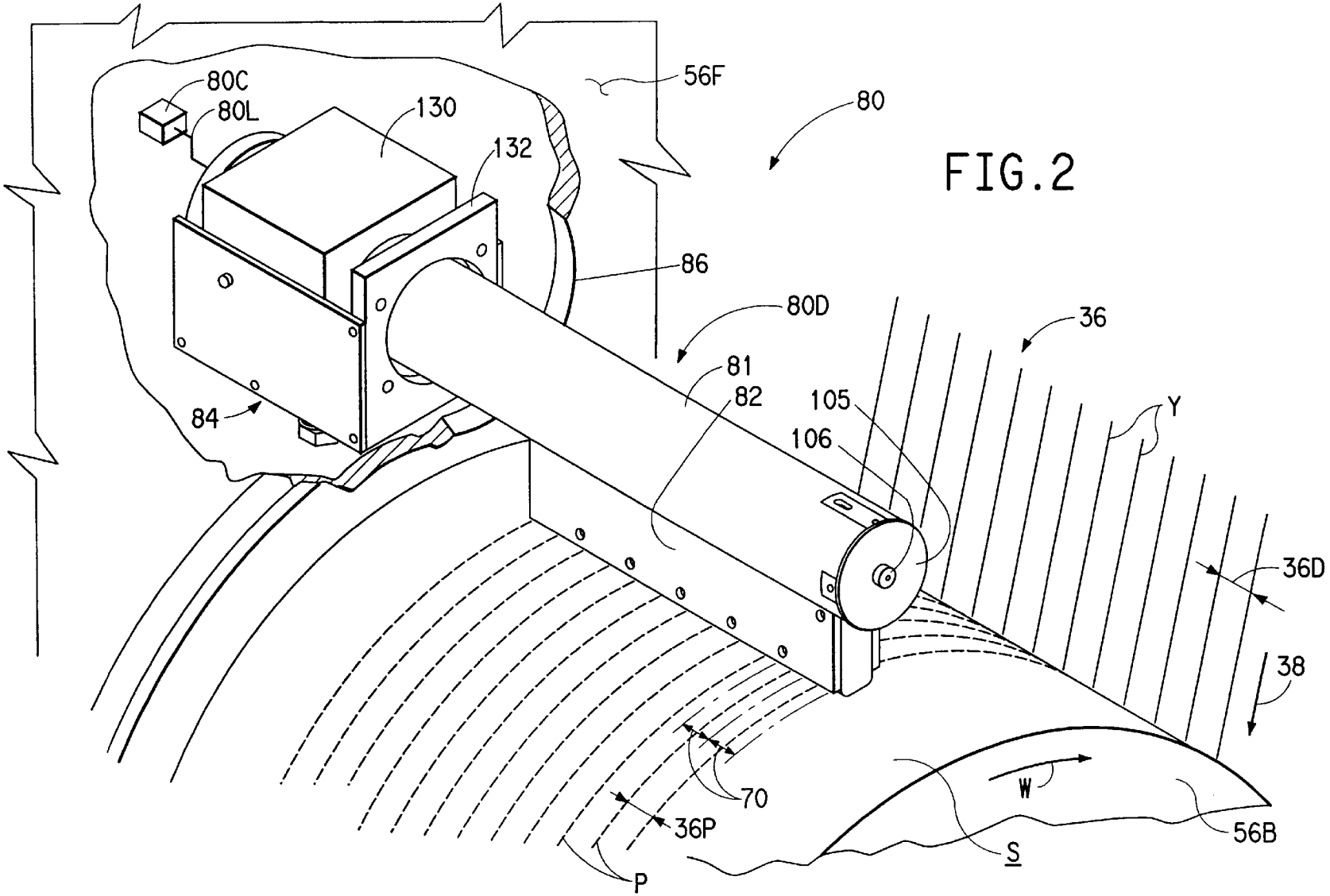
FIG. 2 is a stylized perspective view of the sensor arrangement of the present invention arranged to sense wraps on a portion of a roll surface for processing yarns which are arranged in a warp.

FIG. 2 illustrates one of the rolls 56B and a detector component 80D of sensor 80, which is representative of the relationship of all the detector components to all the rolls with which a sensor is associated. It should be appreciated from the foregoing description that the yarns in the warp remain separated from each other by the transverse clearance distance 36D (FIG. 2) as they pass between rolls and over the surface of each roll, such as roll 56B. Where each yarn contacts the roll, there is defined an imaginary path P on the surface of the roll. The paths are separated from each other by a transverse clearance distance 36P corresponding to the yarn distance 36D. The maintenance of this transverse spacing 36D permits the definition of a plurality of transversely adjacent individual inspection "lanes" 70 on the surface of the rolls. The lanes 70 define imaginary boundaries on the surface of the rolls within which pass the paths of each of the yarns included in the warp 36.

From FIG. 1, it may be observed that as the yarns in the warp 36 proceed sinuously through the treatment module 56, at any given moment only a portion of the total surface of any given roll is in contact with each yarn in the warp. As noted earlier, in the event of a filament break, the yarn may stick to the surface of a roll, which may be highly polished. If some or all of the filaments comprising a given yarn break, the end of the yarn downstream of the break continues through the apparatus, while the broken filaments of the yarn start to wrap around the roll in the direction of roll rotation W. A wrap of yarn will accumulate over the entire circumferential surface of the roll at the transverse position on the roll surface corresponding to the lane of the broken yarn. Over time (either a matter of minutes or seconds, depending on the yarn speed) a gradually widening band of yarn accumulates circumferentially around the surface of the roll in the lane corresponding to the broken yarn. If undetected, this yarn band may interfere with the yarns in an adjacent lane and cause more wraps and breakdown of other yarn lines.

As best seen in FIGS. 1 and 2, in accordance with the present invention, a detector component arrangement generally indicated by the reference character 80D is disposed at a predetermined operative position proximal to surface S of representative roll 56B. In the case of a system utilizing several yarn treatment rolls, each roll that may be prone to accumulate wraps would preferably have a sensor 80 associated therewith including the detector component 80D. In the case of treatment module 56, roll 56E has a release surface thereon that does not tend to accumulate wraps so it optionally does not employ a sensor 80.

Figure 3:
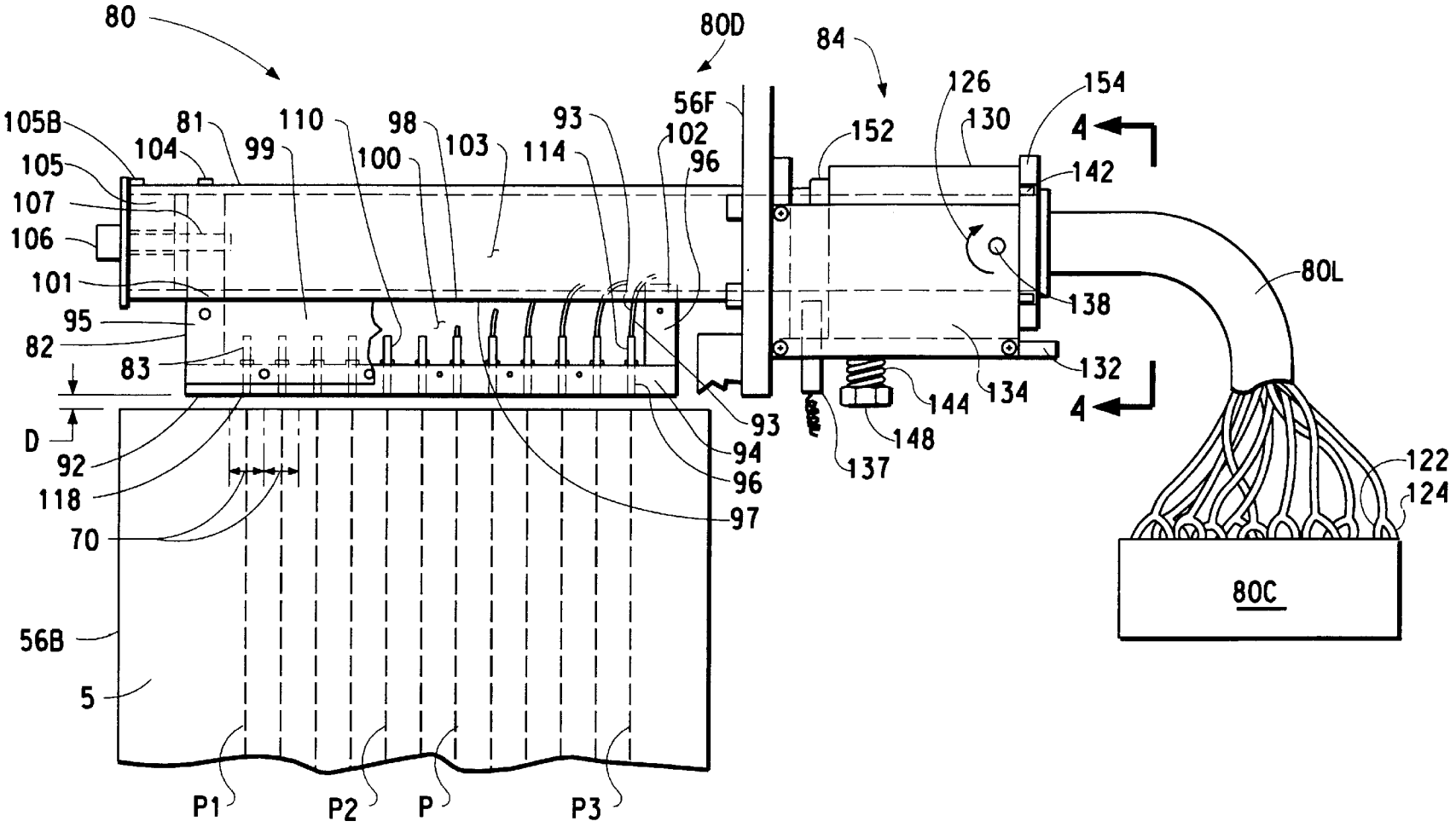
FIG. 3 is a side elevation view partially cut away showing further details of the embodiment of the sensor that interrogates the surface of the roll to detect wrap accumulation by indirect inspection via a fiber optic link.

Referring to FIG. 2, the sensor 80 including detector component 80D is operative to interrogate each of the predetermined plurality of inspection lanes 70 defined on the surface of the roll 56B. The relationship of the inspection lanes 70 with respect to the surface of representative roll 56B is best illustrated in FIGS. 2 and 3. Each inspection lane 70 includes that predetermined transverse portion of the surface of the roll over which a given yarn in the warp 36 is conveyed. The path P of a given yarn within its lane 70 is indicated in FIG. 2. The sensor 80 is operative to generate a signal representative of the presence of a wrap accumulation in the inspection lane 70 corresponding to the predetermined transverse portion of the surface of the roll over which the given yarn is conveyed.

During normal operation, the warp 36 contacts against maybe half of the surface of a given roll. The detector component 80D is positioned with respect to a roll so that, at that same given instant, the sensor interrogates a portion of the remainder of the roll surface. As seen from FIGS. 1 and 2, the detector component 80D of sensor 80 is located so as to view that portion of the surface of the roll with which it is associated which, in the normal course of operation (i. e., in the absence of a wrap), would be free of yarn.

The detector component 80D (FIG. 2) comprises a housing 81 for containing individual fiber optic detectors (one for each yarn inspection lane 70), a detector cover 82 and a base assembly 84. The cabinet 56F is cut away to show the base assembly 84 attached thereto. The housing 81 passes through a hole 86 in the cabinet 56F to reach base assembly 84.

FIG. 3 provides a closer view of the fiber optic type detector component 80D. The detector cover 82 is attached to the housing 81, which is attached to the base 84, which is attached to the cabinet 56F. The protruding end 92 of cover 82 is spaced close to the surface of roll 56B by distance D, which may typically be about 0.25 inches. Individual yarn wrap detectors, such as detector 83, are arranged within the cover 82 to be aligned with the paths P that yarn wraps would take on roll 56B. For instance, detector 83 is aligned with path P1, and detector 110 is aligned with path P2, and detector 114 is aligned with path P3 closest to the cabinet 56F. The sensors are of the optical fiber type which have a first optical fiber end aligned with the tip of each detector, such as tip 118 of detector 83, and a second opposite end terminating in control housing 90. The optical fibers comprise both receiving fibers and transmitting fibers that are blended and bundled together at the tips, such as tip 118. The field of view of the fibers at the tip is typically about 0.37 inches in diameter and is centered over the yarn path P. The spacing between detector tips is the same as the transverse clearance distance 36D between yarns.

The fibers from the detectors are contained in a sheath, such as sheath 93 for detector 114 and the sheaths are contained in cover 82 and are conducted inside housing 81 in a hollow passage 103, through base assembly 84, and are conducted back within cabinet 56F. Within cabinet 56F, the sheaths are gathered together into a communication link 80L and routed to control component 80C. At the second opposite ends of the optical fibers at control component 80C, all the receiving fibers for a given tip, such as tip 118, are separated into a receiving bundle, such as bundle 122, and the transmitting fibers, such as for tip 118, are separated into a transmitting bundle, such as bundle 124.

The transmitting fibers receive IR (infrared) radiation from within control component 80C and transmit it through bundle 124 to tip 118. The IR radiation is projected from the transmitting fibers in the tip onto the surface S of roll 56B. The IR radiation is then reflected from the surface of roll 56B and back to the tip 118 where it is collected by the receiving fibers at the tip 118. The received radiation is then passed through the receiving bundle 122 and is detected by an IR detector within control component 80C. It is beneficial to keep the control component 80C spaced away from the heat, yarn finish vapors and spray, and harsh electrical noise in the environment of the rolls; such an environment might interfere with or damage the controls. On the other hand, the fiber optic detectors, such as detectors 83, 110, and 114 are not sensitive to this harsh environment. Such a system of transmitting and receiving fibers can be obtained from the Cuda Products Corp. in Jacksonville, Fla. The control component preferably includes signal processing circuitry to enable the operator, during setup, to make adjustments to filter out recurring reflected signals, such as those that originate from scratches or the like on the rotating roll surface. The IR frequency used would preferably be one that is not affected by finish fluids and mist that are present when processing the particular yarns. A wavelength for the IR light used in the sensor that has been found to work well and not be affected by common yarn finishes is a wavelength of 860–890 nanometers.

Each sensor for a roll would have its own control component 80C which would monitor individual detectors and generate a signal that could be used to alert the operator when a yarn wrap for a particular yarn line is detected by a particular sensor. The operator could then take appropriate action, such as cutting down the wrapped yarn line and thereby limiting the size of the yarn band formed by the wrapping yarn. The operator could then disable the sensor for the roll having the wrap and could extract the yarn band from the surface of the roll by sliding it past the remaining running yarn lines to the free end of the roll. The sensor must be disabled during wrap removal or the sensors for the remaining inspection lanes would detect the sliding wrap as it passed and would indicate additional wraps unnecessarily. At the free end of the roll, the wrap can then be removed and the yarn line re-threaded over the rolls and placed in its respective path.

Referring to FIG. 3, the cover 82 for detector component 80D further comprises a bar 94 having threaded holes 96 for holding the threaded detectors, such as detector 114. Attached to bar 94 are a first end plate 95 and a second end plate 96 that pass through a slot 97 on the bottom side of housing 81. The sides of the slot 97 define opposed tracks 98 that engage grooves 101 and 102 in end plates 95 and 96 respectively. Side plates 99 and 100 are attached to the end plates and bar to enclose the detectors. The first end plate 95 extends through hollow passage 103 in housing 81 to the far side of the passage. Locking bolt 104 holds end plate 95 to the top of housing 81. Plug 105 covers the end of passage 103 and provides an opening for adjusting bolt 106 to pass through the plug and engage a threaded hole 107 in end plate 95. When locking bolt 104 is loosened, adjusting bolt 106 can be held in contact with plug 105 and threaded in and out of end plate 95 to cause the cover 82 and its assembled elements to move axially along housing 81. This permits the attached detectors to be easily aligned with the group of yarn paths P on the surface S of the roll if the paths should shift slightly from one product setup to another. When the detectors are in position, the cover is locked in place by locking bolt 104 engaging end plate 95.

If one of the detectors were to fail, the plug bolt 105B and locking bolt 104 can be removed so the cover 82 and all parts assembled thereto can be withdrawn from passage 103 of housing 81 along tracks 98. The ends of the fiber optic sheaths, such as the receiving bundle 122 and the transmitting bundle 124 would be disconnected from the control housing 90. The cable of sheaths in communication link 80L could then be withdrawn through the passage 103 and the entire cover assembly rapidly replaced. The cover assembly with the failed detector could then be repaired offline.

Figure 4:
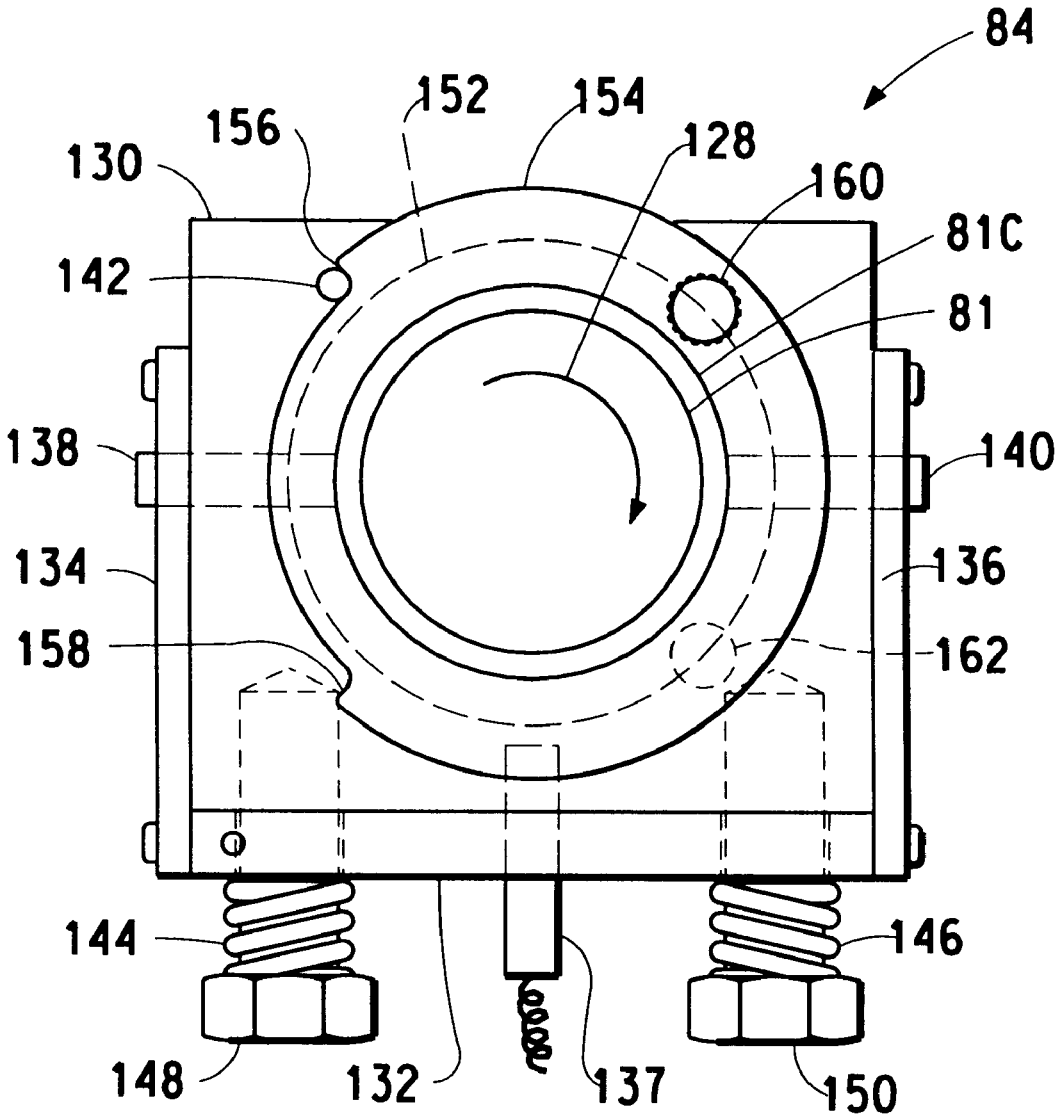
FIG. 4 is an end view 4—4 of FIG. 3 showing details of the base assembly for supporting the sensor.

The housing 81 (FIGS. 3 and 4) is supported by a base assembly 84 that permits the housing and attached cover 82 to tilt in direction 126 away from roll 56B and to rotate around the housing center axis, as seen in FIG. 4, in the direction 128. The base comprises a bearing block 130, a frame 132, side plates 134 and 136, tilt pins 138 and 140, stop pin 142, springs 144 and 146, and bolts 148 and 150. The L-shaped frame 132 has plate 134 attached to one side and plate 136 attached to the opposite side. Tilt pins 138 and 140 are fixed in block 130 and pin 138 is pivotably supported in plate 134 while pin 140 is pivotably supported in plate 136. Bolts 148 and 150 pass through springs 144 and 146 respectively and pass through clearance holes in frame 132 and are threaded into block 130.

The purpose of the springs 144 and 146 is to bias the block 130 against frame 132 to resist tilting in direction 126. This is most useful (referring to FIG. 1) in the situation where the detector component 80D is positioned below a roll, such as is the case with sensor 80 for rolls 56A and 56C. In this case, the springs must resist tilting due to the force of gravity acting on the housing and the components assembled thereto that extend beyond the cabinet 56F. In the case of the detector components 80D positioned above rolls 56B and 56D, gravity forms a biasing force to resist tilting and the springs may not be needed. Preferably, springs 144 and 146 are used regardless of the orientation of the sensor to provide a standardized assembly and a robust operation.

The housing 81 passes through a clearance hole 81C in block 130 and is held in place with a first housing collar 152 that clamps onto housing 81 on one side of the block 130, and a second housing collar 154 on the opposite side of block 130. The collars axially locate housing 81 in block 130. The second housing collar 154 has shoulders 156 and 158 that interact with stop pin 142 attached to block 130; and spring plunger 160 that interacts with detents (one shown at 162) in block 130.

Referring to FIGS. 2, 3 and 4, in operation, if a wrap occurs and is somehow not detected by the sensor 80 or the operator does not respond to the wrap accumulation signal, a large wrap may build up and eventually contact the cover 82. When this happens, the wrap may cause the cover 82 and attached housing 81, bearing block 130, and bolts 148 and 150 to tilt upward relative to frame 132 in direction 126 by overcoming the springs 144 and 146 and tilting around tilt pins 138 and 140 that are able to rotate in side plates 134 and 136. A switch 137 is attached to block 134 and is positioned to detect the normal position of housing 81 in the block. If housing 81 tilts upward, the switch senses this and provides a separate signal that can be used to inform the operator. If there is excessive drag against the sensor cover caused by contact with the wrap on rotating roll 56B, the cover 82 and attached housing 80 may also rotate within bearing block 130 in direction 128 by overcoming the spring plunger 160 resting in the detent in bearing block 130. The tilting and rotating protect the sensor from damage due to malfunction of a detector or failure of an operator to cut down the wrapping yarn that may allow an excessively large wrap to build up on roll 56B. The rotating feature is also useful to rotate the cover 90 degrees until spring plunger 160 seats in detent 162 to make the detector tips accessible for cleaning or inspection, and to remove the detector component from the close spacing D with the surface S for roll cleaning and inspection.

The sensor must sense a wrap of a few filaments and continue sensing the wrap until a sufficient amount of yarn wrap is accumulated that can be easily and readily removed. It must also reliably sense a wrap that is small enough that an excessively large wrap does not accumulate that would be difficult to remove or that may fill the distance D and interfere with the detector component.

Figure 5:
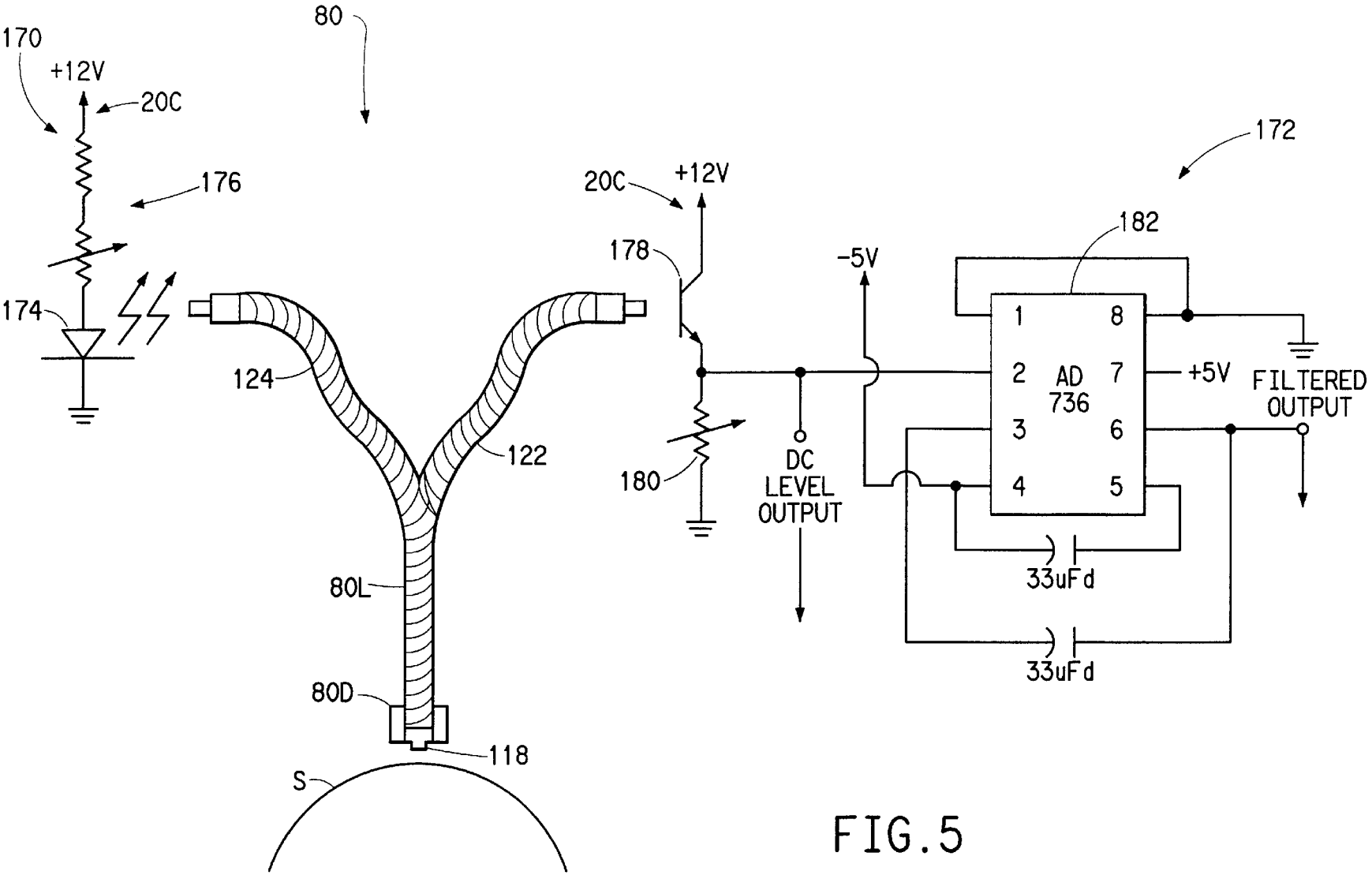
FIG. 5 is an electrical diagram of the circuitry for forming a wrap accumulation signal.

A circuit that has been found to work well to sense a predetermined amount of wrap on a roll and send a wrap accumulation signal is shown in FIG. 5. On the left side of FIG. 5 is a transmitter circuit 170 that sends the IR signal along the transmitting bundle of fibers 124 of the fiber optic communication link 80L. On the right side of FIG. 5 is a receiver circuit 172 that takes the signal from the receiving bundle of fibers 122 and generates the wrap accumulation signal. These two circuits 170 and 172 are part of the control component 80C. The transmitter circuit comprises an infrared LED 174 which emits light having a wavelength of about 890 nanometers, and a resistor network 176 that limits and allows adjustment of the intensity of the light emitting diode (LED). The light is coupled into the end of the transmitting bundle 124 and travels to the tip 118 and is projected onto the roll surface S from which it is reflected. The reflected light travels back through the fiber-optic sheath for that detector and through signal communication link 80L and to receiving fiber bundle 122 in control component 80C.

The receiver circuit comprises a phototransistor 178, a bias adjustment resistor 180, and an RMS to DC converter chip 182. The photo-transistor 178 provides a DC current flow proportional to the light intensity projected on it by the receiving bundle of fibers 122. With no wrap on the roll, the maximum light is being reflected from the roll surface and back to the photo-transistor. This roll surface signal from the phototransistor may be noisy due to imperfections and debris on the reflective surface of the roll. The chip 182 acts as a low pass filter to clean up this roll surface signal to generate a reference level signal. Once a wrap occurs on the roll surface, the roll surface signal at the unfiltered DC level point or at the filtered reference level point will gradually diminish at a predictable rate as the width of the wrap gradually widens and blocks the reflected IR from the roll surface indicating a wrap has started and is accumulating. This diminishing wrap accumulation signal can be used to indicate a wrap is occurring and can be used to indicate the size (width and thickness) of the wrap. As the wrap increases in width, it covers more of the roll surface in the field of view of the detector tip, and as the wrap increases in thickness, it develops an irregular curved surface on top that scatters more of the projected IR light so less is reflected to the receiving fibers in the detector tip. This signal generated by the sensor can be visually presented to the operator as with a scope or meter or other device to alert the operator to take some action to take appropriate action for the wrap accumulation as explained. The receiver, thereby, is responsive to the diminution of infrared radiation reflected from the surface of the roll due to the wrap accumulation of yarn on the roll to generate the accumulation signal, the signal representing a predetermined accumulation of wrapped yarn on the surface that facilitates subsequent removal.

What is claimed is:

1. In an apparatus for processing a synthetic yarn that includes a yarn treatment roll having a cylindrical surface, the yarn being conveyed over at least a portion of the surface of the roll, the improvement comprising:

a sensor comprising a detector component, a communication link, and a control component, the sensor arranged for generating a signal representative of a circumferential wrap accumulation of yarn on the surface of the roll;

the detector component arranged over a second portion of the roll circumferentially spaced from said portion conveying said yarn, the second roll portion being in a heated, electrically noisy environment;

the control component comprising an infrared transmitter and infrared receiver disposed in a location remote from the heated, electrically noisy environment of the roll, the transmitter and the receiver each being coupled via said communication link comprising a respective fiber optic link to direct infrared energy toward and to collect infrared energy reflected from the cylindrical surface of the roll, the cylindrical surface of the roll defining a reflector of incident energy from the transmitter;

the receiver being responsive to the diminution of infrared radiation reflected from the surface of the roll due to the wrap accumulation of yarn on the roll to generate the accumulation signal, the signal representing a predetermined accumulation of wrapped yarn on the surface that facilitates subsequent removal.

2. A detector component for a wrap accumulation sensor for detecting at least one wrap imaginary circumferential yarn paths on a surface of a roll for treating a warp of yarns, comprising:

an elongated housing having an axis extending parallel to the axis of said roll;

a cover attached to the housing and protruding from said housing along said axis, the protruding end of the cover spaced close to the surface of said roll and containing a detector for inspecting the surface of the roll at each yarn path for said warp;

a base assembly for supporting the housing in a position adjacent said roll;

tiltable support means in said base for allowing tilting of said housing relative to said roll surface by contact of said cover with a yarn wrap, and biasing means to resist tilting of said housing;

rotatable support means in said base for allowing rotation of said housing around the housing axis by contact of said cover with a yarn wrap, and biasing means to resist rotation of said housing.

3. The detector component of claim 2, further comprising:

a hollow passage in said housing wherein the cover extends into the passage;

opposed tracks in said housing for slideably attaching the cover to permit movement along the housing axis;

a plug attached to the housing and covering one end of the passage in the housing;

a screw passing through the plug and engaging the cover in the passage for moving the cover axially along the tracks;

anchoring means for rigidly holding the cover in a fixed axial position in said housing.

4. The detector component of claim 2 including fiber optic fibers terminating in an end surface at the protruding end of the cover adjacent the roll surface and terminating in an opposite end remote from the roll.

5. The detector component of claim 4, further comprising a control housing in communication with the opposite end of the fibers, the control housing transmitting IR light to a portion of the fibers for projection onto the surface of the roll, and the control housing receiving and detecting reflected IR light from the surface of the roll from the remaining portion of the fibers.

* * * * *